US011780075B2

(12) United States Patent
Barton

(10) Patent No.: US 11,780,075 B2
(45) Date of Patent: Oct. 10, 2023

(54) SECURING COMPARTMENTS FOR MODULAR STORAGE

(71) Applicant: Milwaukee Electric Tool Corporation, Brookfield, WI (US)

(72) Inventor: George Barton, Mequon, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 17/116,837

(22) Filed: Dec. 9, 2020

(65) Prior Publication Data

US 2021/0154824 A1 May 27, 2021

Related U.S. Application Data

(63) Continuation of application No. PCT/US2020/061962, filed on Nov. 24, 2020.

(60) Provisional application No. 62/940,393, filed on Nov. 26, 2019.

(51) Int. Cl.

| | |
|---|---|
| ***B25H 3/02*** | (2006.01) |
| ***B65D 25/04*** | (2006.01) |
| ***A45C 11/00*** | (2006.01) |
| ***A45C 13/10*** | (2006.01) |

(52) U.S. Cl.

CPC ..... *B25H 3/028* (2013.01); *A45C 11/00* (2013.01); *A45C 13/1084* (2013.01); *B65D 25/04* (2013.01)

(58) Field of Classification Search

CPC ..... B25H 3/028; B65D 25/04; A45C 11/00; A45C 13/1084

USPC ..... 206/372

See application file for complete search history.

(56) References Cited

U.S. PATENT DOCUMENTS

| | | | |
|---|---|---|---|
| 5,016,946 | A | 5/1991 | Reznikov et al. |
| 6,176,559 | B1 | 1/2001 | Tiramani et al. |
| 6,347,847 | B1 | 2/2002 | Tiramani et al. |
| 6,578,937 | B1 | 6/2003 | Thoman |
| 6,601,930 | B2 | 8/2003 | Tiramani et al. |
| 7,832,584 | B2 | 11/2010 | Eggers et al. |

(Continued)

FOREIGN PATENT DOCUMENTS

| | | |
|---|---|---|
| CN | 204800609 | 11/2015 |
| CN | 105291075 | 2/2016 |

(Continued)

OTHER PUBLICATIONS

International Search Report and Written Opinion for International Application No. PCT/US2020/061962, dated Mar. 15, 2021, 10 pages.

*Primary Examiner* — J. Gregory Pickett
*Assistant Examiner* — Sanjidul Islam
(74) *Attorney, Agent, or Firm* — Reinhart Boerner Van Deuren s.c.

(57) ABSTRACT

Various storage units that stack with other units, such as in a modular system, are provided. The storage units couple within a modular system via coupling interfaces on the top and/or bottom surfaces that couple the storage units to other units in the modular system. The storage units include a cover and a latch, the cover restricting one or more drawers from being opened. In a specific embodiment, the cover is slidably stored within the housing of the storage unit. The storage unit includes one or more internal storage compartments defined at least in part by the one or more drawers.

8 Claims, 22 Drawing Sheets

(56) References Cited

U.S. PATENT DOCUMENTS

| | | | | |
|---|---|---|---|---|
| 8,657,307 | B2 | 2/2014 | Lifshitz et al. | |
| D803,560 | S | 11/2017 | Kuhls | |
| D803,561 | S | 11/2017 | Kuhls | |
| 10,047,546 | B2 | 8/2018 | Brunner | |
| 10,182,628 | B2 | 1/2019 | Tonelli et al. | |
| 10,286,542 | B2 | 5/2019 | Wolle et al. | |
| 10,293,477 | B2 | 5/2019 | Wolle et al. | |
| 10,314,399 | B2 | 6/2019 | Wolle et al. | |
| 10,583,962 | B2 | 5/2020 | Brunner et al. | |
| 2002/0117414 | A1* | 8/2002 | Kipper | B25H 3/028 206/811 |
| 2006/0006770 | A1 | 1/2006 | Valentini | |
| 2006/0132006 | A1* | 6/2006 | Schluter | H05K 5/0226 312/323 |
| 2009/0145790 | A1 | 6/2009 | Panosian et al. | |
| 2010/0108549 | A1* | 5/2010 | Eggers | B25H 3/028 206/349 |
| 2011/0155613 | A1* | 6/2011 | Koenig | B65D 21/0223 206/503 |
| 2017/0166352 | A1* | 6/2017 | Hoppe | B25H 3/022 |
| 2018/0161975 | A1 | 6/2018 | Brunner | |
| 2018/0186513 | A1 | 7/2018 | Brunner | |
| 2018/0200875 | A1 | 7/2018 | Wolle et al. | |
| 2019/0106244 | A1 | 4/2019 | Brunner et al. | |
| 2019/0225371 | A1 | 7/2019 | Hoppe et al. | |
| 2020/0147781 | A1 | 5/2020 | Squiers et al. | |
| 2020/0165036 | A1 | 5/2020 | Squiers et al. | |

FOREIGN PATENT DOCUMENTS

| | | |
|---|---|---|
| CN | 206643887 | 11/2017 |
| CN | 107708935 | 2/2018 |
| CN | 108477483 | 9/2018 |
| CN | 209014323 | 6/2019 |
| DE | 4207878 | 9/1993 |
| DE | 29812086 | 10/1998 |
| DE | 202011107073 | 2/2012 |
| DE | 202014103228 | 11/2015 |
| EP | 0482337 | 12/1997 |
| EP | 1563965 | 12/2006 |
| WO | WO05021221 | 3/2005 |
| WO | WO 2015/034837 | 3/2015 |
| WO | WO19081711 | 5/2019 |

* cited by examiner

| FEATURES | 2 DOOR CONCEPT | SINGLE DOOR CONCEPT |
|---|---|---|
| DROP TEST RATING | ☆ | ☆☆ |
| PRODUCTION COMPLEXITY | ☆ | ☆☆ |
| WATER AND DUST RESISTANCE | ☆☆ | ☆☆½ |
| DOOR CLOSING MECHANISM + PAD LOCK | ☆☆ | ☆☆☆ |
| DOOR INTERFERENCE WHEN OPEN | ☆☆ | ☆☆☆ |

SECURING COMPARTMENTS FOR MODULAR STORAGE

CROSS-REFERENCE TO RELATED PATENT APPLICATION

The present application is a continuation of International Patent Application No. PCT/US2020/061962, filed on Nov. 24, 2020, which claims the benefit of and priority to U.S. Provisional Application No. 62/940,393, filed on Nov. 26, 2019, which are incorporated herein by reference in their entireties.

BACKGROUND OF THE INVENTION

The present disclosure is directed generally to the field of tool storage systems and related devices. The present disclosure relates specifically to a device or tool storage container that includes a covering panel to secure storage compartments, and a coupling mechanism to detachably couple the device or tool storage container to another such device or container, such as in a modular tool storage system.

Tool storage units are often used to transport tools and tool accessories. Some storage units are designed to incorporate into a modular storage system. Within a modular storage system, different units, devices and/or containers may provide varying functions, such as being adapted to secure contents within the storage unit for transportation or security.

SUMMARY OF THE INVENTION

One embodiment of the disclosure relates to a container including a housing, a first interface located along an upper surface of the housing, the first interface configured to couple the housing to a modular tool storage device, a drawer slidably coupled to the housing, a cover pivotally coupled to the housing, and a latch coupled to the housing that detachably engages with the cover. The drawing encloses a compartment. The latch is engaged with the cover when the cover is in the locked position and retains the cover in the locked position. The cover interfaces with an outer surface of the drawer to restrict the drawer from opening when the cover is in a locked position.

Another embodiment of the disclosure relates to a container including a housing, a first interface located along an upper surface of the housing, the first interface configured to couple the housing to a modular tool storage device, a drawer slidably coupled to the housing that actuates between an open position and a closed position, and a retainer pivotally coupled to the housing. The drawer encloses a compartment. The retainer actuates between at least two positions including a locked position and a stowed position. When in the locked position, the drawer is restricted from being moved from the open position to the closed position. When in the stowed position, the retainer is retracted within the housing and the drawer can be moved from the open position to the closed position. The drawer encloses a compartment.

Another embodiment of the disclosure relates to a modular storage system including a container and a storage unit. The container includes a top panel, a bottom panel, a sidewall extending between the top panel and the bottom panel, and an interior space defined by the top panel, the bottom panel and the sidewall. The container includes a first interface located along an upper surface of the housing, the first interface configured to couple the housing to a modular tool storage device. The container includes a drawer slidably coupled to the housing, the drawing extending and retracting through the sidewall from the interior space. The drawer encloses a compartment. The storage unit includes a lower surface, a second interface located along the upper surface. The second interface is configured to detachably engage with the first interface of the container. The storage unit includes a housing defining a storage compartment.

Another embodiment of the disclosure relates to a tool storage device that includes a housing, a first coupler extending from a top face, a top panel coupled to the housing, a compartment within the housing, a drawer that encloses the compartment when the drawer is in a closed position, a cover that restricts the drawer from opening when the cover is in a secured position, a handle that is coupled to and extends from the cover, and a latch that engages with the handle when the cover is in the secured position. The first coupler is engageable with another tool storage device.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION

Referring generally to the figures, various embodiments of a stackable tool storage related device, container or unit are shown. One or more of the devices are configured to selectively couple and decouple with storage units. The tool storage device includes a retainer or cover (e.g., door and/or wire frame) that secures compartments within the stackable tool storage related device, container or unit. In a specific embodiment, the cover keeps compartment drawers in place and closed during transit of the stackable tool storage related device, container or unit. When the cover is in a secured position, the cover engages with a latch that is coupled to the housing.

As compared to a unit with two covering doors that pivotally open to expose the drawers, one advantage of this design is the covering door being fully immersed in the body and therefore activity near the storage unit. Another advantage of this design is an improved structural rigidity when closed compared to the two doors design. Other advantages of this design over the two door design are that there are fewer components to assemble, this design can be easier to use.

Figure 1:
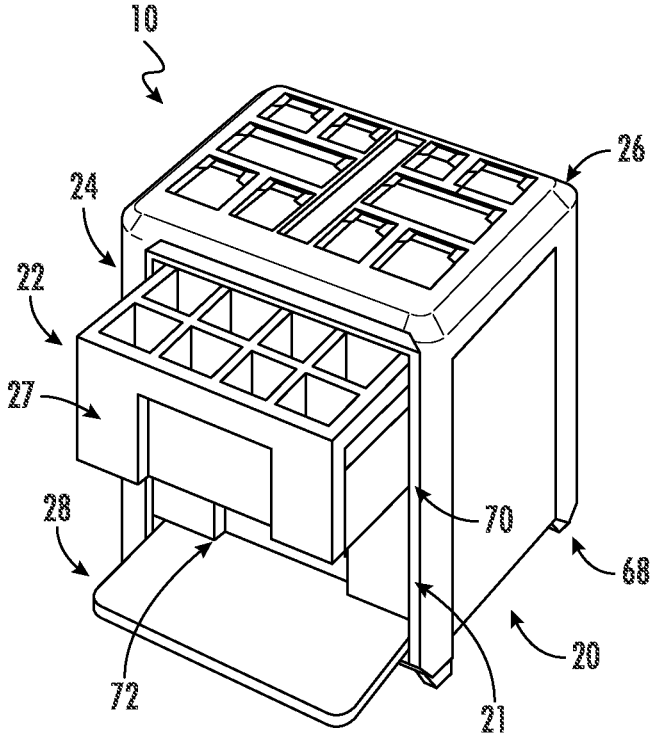
FIG. 1 is a perspective view of a tool storage device, according to an exemplary embodiment.
Figure 2:
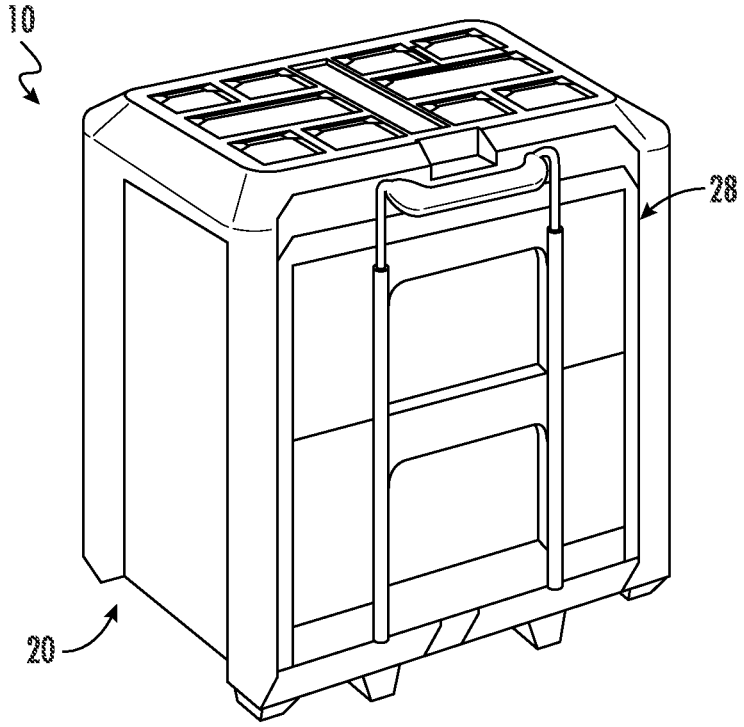
FIG. 2 is a perspective view of the tool storage device of FIG. 1, according to an exemplary embodiment.

Referring to FIG. 1 and FIG. 2, a container and/or device, such as tool storage device 10, is shown according to an exemplary embodiment. Tool storage device 10 includes storage compartments 24 that are collectively defined by drawers 22 and/or housing 20. In a specific embodiment, drawers 22 enclose compartments 24. A retainer or cover, shown as door 28, is movable between various positions with respect to housing 20 and drawers 22, including a secured position, an open position and a retracted position. Door 28 is pivotally coupled to housing 20 such that the door 28 actuates between at least two positions: a locked position in which the drawer(s) 22 are restricted from being moved from the open position to the closed position, and a stowed position in which door 28 is retracted within the housing 20 and the drawer(s) 22 can be moved from the open position to the closed position. When in the secured position, such as depicted in FIG. 2, door 28 restricts and/or prevents access to storage compartments 24 by preventing drawers 22 from fully opening. Drawers 22 are slidably coupled to housing 20.

Door 28 is pivotally coupled to the housing 20 such that door 28 interfaces with an outer surface 27 of the drawers 22 to restrict the drawers 22 from opening when the door 28 is in a locked position. When door 28 is in the open and/or retracted positions, drawers 22 are slidable out of a front opening of housing 20. Drawers 22 slide out of housing 20 by moving in a direction generally parallel to the top panel 26 of tool storage device 10 and/or by moving in a direction generally perpendicular to the front of housing 20.

Tool storage device 10 includes a first interface 80 located along an upper surface 25 of a top panel 26 the housing 20. The first interface 80 is configured to couple the housing 20 to a modular tool storage device, such as via the coupling mechanism(s) described in International Patent Application No. PCT/US2018/044629, which is incorporated herein by reference in its entirety.

In a specific embodiment, tool storage device 10 includes a top panel 26, a bottom panel 68, and a sidewall 70 that extends from top panel 26 to bottom panel 68. In a specific embodiment, sidewall 70 is a front of housing 20. An interior space 72 is defined by top panel 26, bottom panel 68 and sidewall 70. One or more drawers 22 extend and retract from interior space 72 through sidewall 70.

Figure 5:
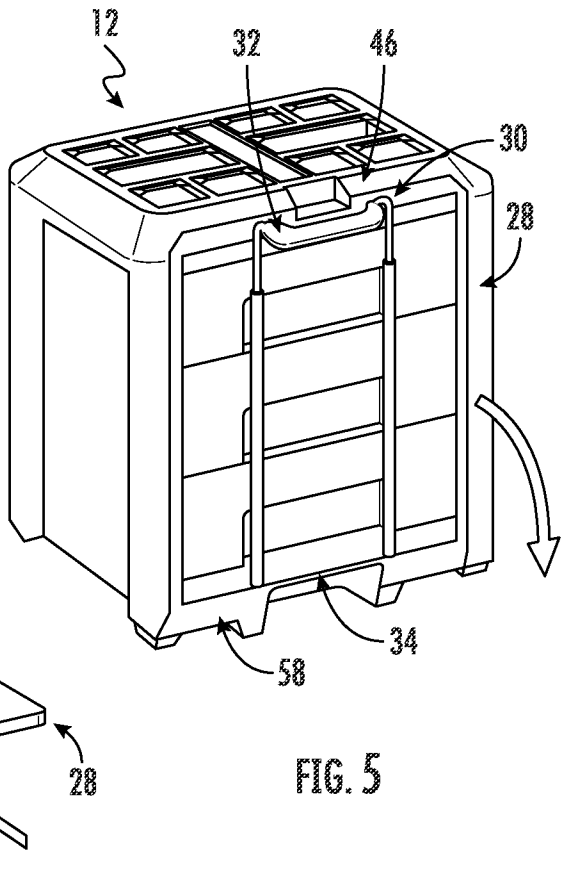
FIG. 5 is a perspective view of the tool storage device of FIG. 3, according to an exemplary embodiment.
Figure 4:
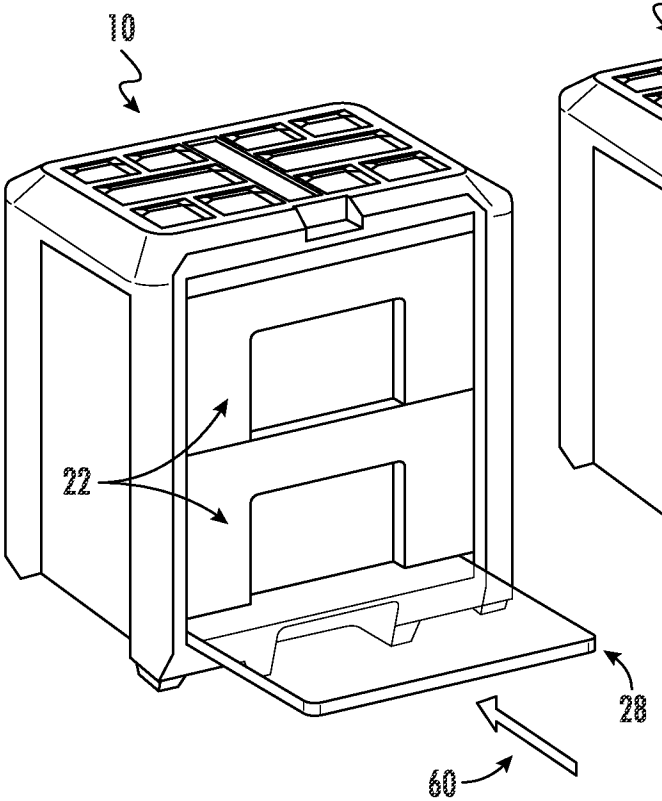
FIG. 4 is a perspective view of the tool storage device of FIG. 1, according to an exemplary embodiment.
Figure 3:
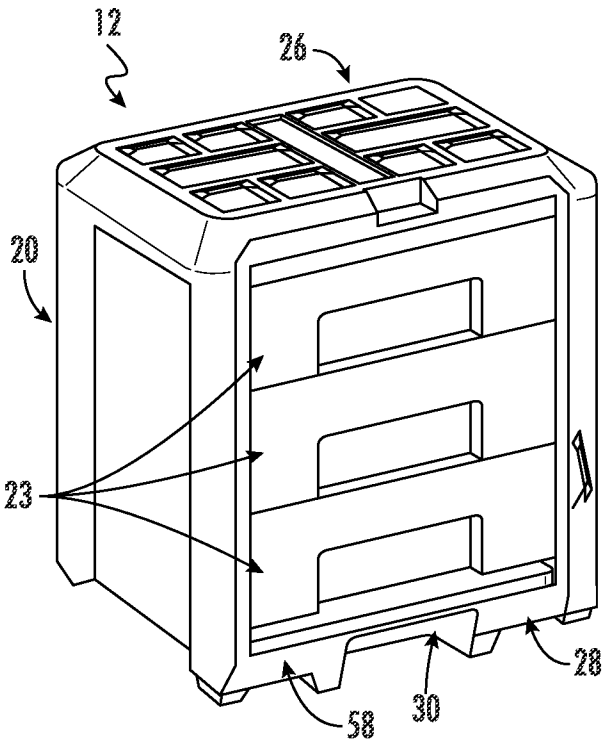
FIG. 3 is a perspective view of a tool storage device, according to an exemplary embodiment.

Referring to FIGS. 3-5, various positions for door 28 are depicted for tool storage device 10 and tool storage device 12. Tool storage device 12 is substantially the same as storage device 10 except for the differences discussed herein. Tool storage device 12 includes three drawers 23, whereas tool storage device 10 includes two drawers 22.

FIG. 5 depicts door 28 in secured position, FIG. 4 depicts door 28 in an open position, and FIG. 3 in a retracted position within cavity 58 defined by housing 20. Turning to FIG. 5, door 28 is in a secured position that restricts and/or prevents access to storage compartments 24 by preventing drawers 22 from fully opening. Handle 30 is coupled to door 28 and protrudes from first end 32 of door 28. Top panel 26 is coupled to latch 46. Latch 46 detachably engages with a cover, shown as door 28. When door 28 is in a secured position, handle 30 is engaged with latch 46 and second end 34 of door 28 is just outside cavity 58 that receives door 28. Latch 46 is engaged with door 28 when the door 28 is in the locked position and retains door 28 in the locked position. When the door 28 is in the open position, drawers 22 are slidable out of housing 20. When latch 46 is disengaged from door 28, door 28 is rotateably with respect to housing 20 to an open position.

In a specific embodiment, drawers 22 slide out of housing 20 in a direction generally perpendicular to a front surface 21 of housing 20. After latch 46 is disengaged from handle 30, door 28 is rotateable in direction 52 to the open position (FIG. 4). Turning to FIGS. 3 and 4, door 28 is rotated until door 28 is approximately parallel to top panel 26 (see FIG. 4), and then door 28 is inserted in direction 60 into cavity 58 of housing 20 (see FIG. 3). Door 28 actuates between an open position, a locked position, and a stowed position in which the door 28 is within a cavity 58 defined by housing 20 (FIG. 3).

Figure 6:
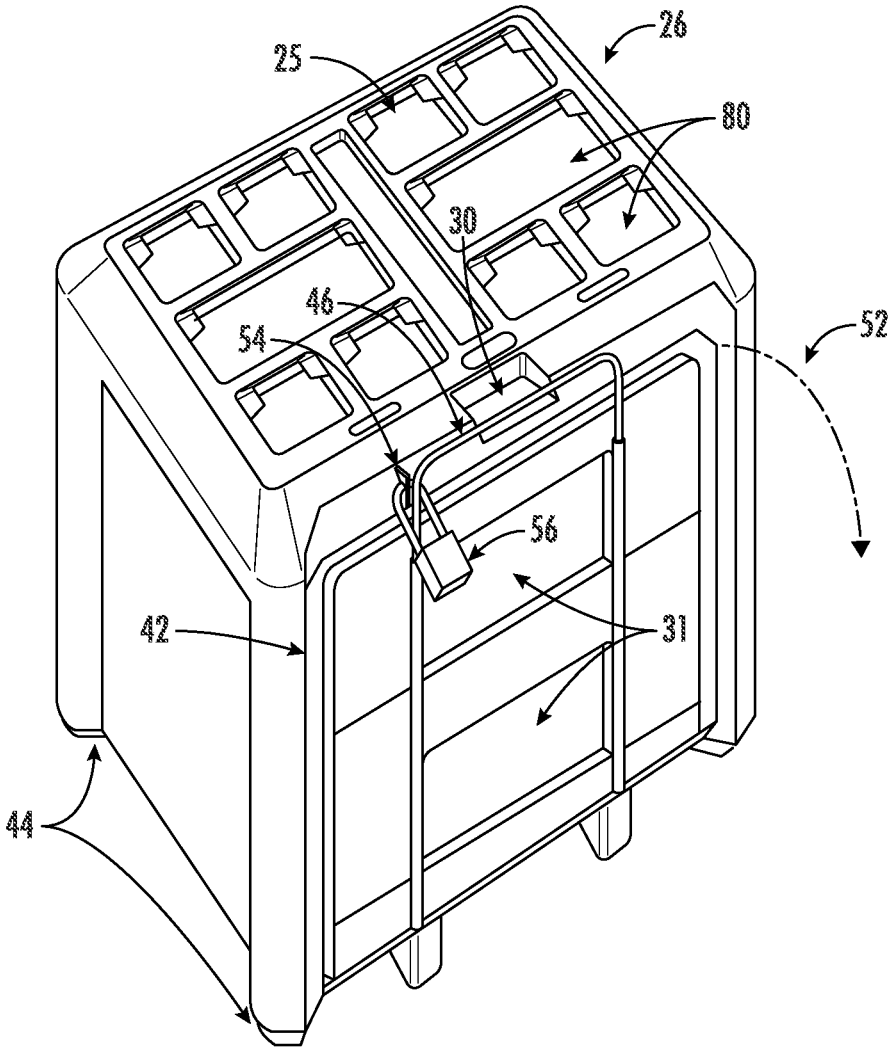
FIG. 6 is a perspective view of the tool storage device of FIG. 1, according to an exemplary embodiment.

Turning to FIG. 6, tool storage device 10 includes latch 46, a handle, shown as a metal handle 30, seal 42, and corner bumpers 44. A fastener, shown as locker 56, secures handle 30 to top panel 26. In a specific embodiment, locker 56 couples door 28 to housing 20. Locker 56 couples handle 30 to locking aperture 54 defined by top panel 26. Locker 56 restricts door 28 from pivoting in direction 52, and therefore prevents drawers 22 from being fully opened.

Figure 7:
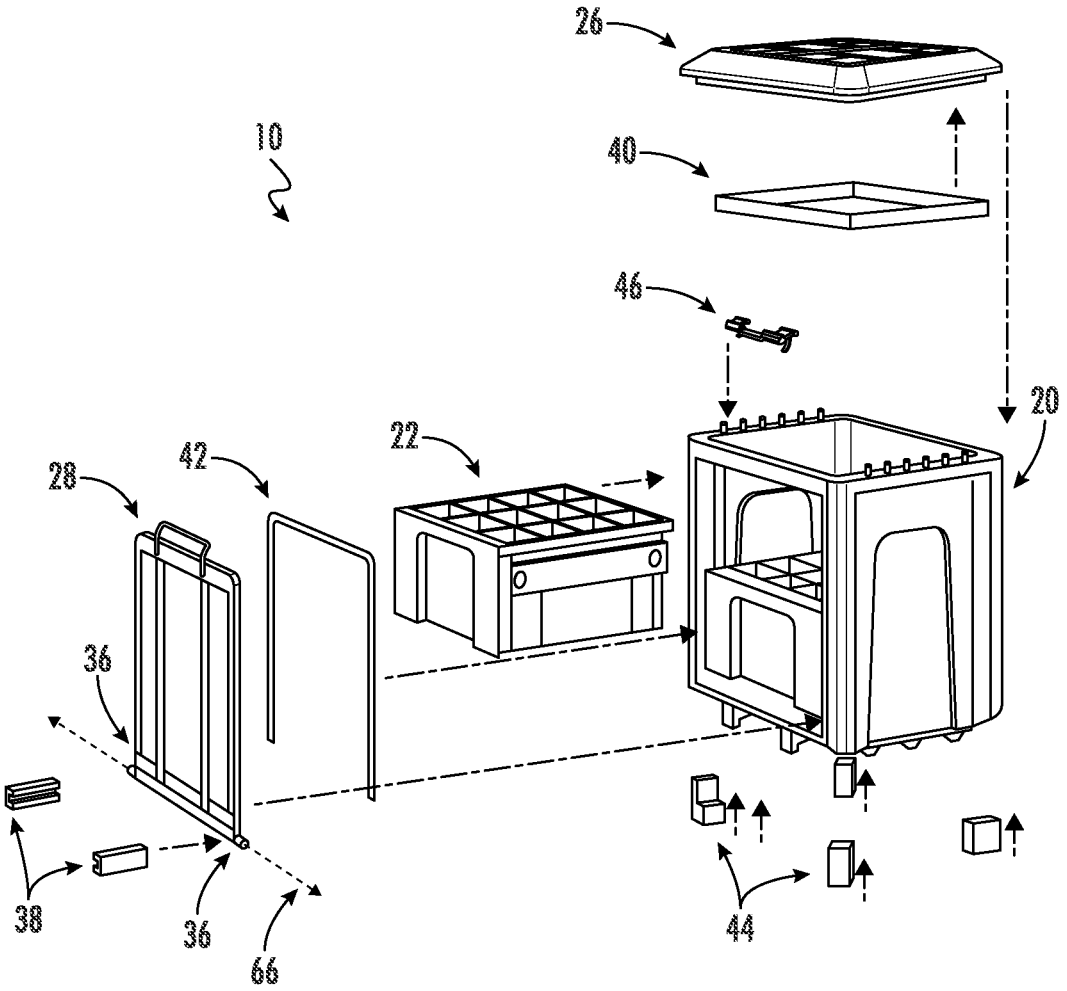
FIG. 7 is a perspective view of the tool storage device of FIG. 1, according to an exemplary embodiment.

Turning to FIG. 7, tool storage device 10 includes top panel 26 and housing cover 40, which are secured together and coupled to housing 20. Latch 46 is pivotally coupled to top panel 26. Bumpers 44 are coupled to bottom of storage device 10. Drawer 22 slides into and out of housing 20. Seal 42 couples to tool storage device 10 and interfaces with door 28 when door 28 is in a secured position. Tracks 38 are coupled to housing and interface with protrusions 36 that extend laterally from door 28 away from each other. Protrusions 36 pivotally couple door 28 to the housing 20. When transitioning from the secured position (see FIG. 5) to the open position (see FIG. 4), door 28 rotates around rotational axis 66 with respect to housing 20.

In a specific embodiment, door 28 comprises an elongate continuous metal frame surrounding an open central area 31, such as a wire frame (FIG. 6). In a specific embodiment, the wire frame is a thin, elongate structure that engages with a relatively small portion of outer surface 27 of the drawers 22 (e.g., <10% of the surface area of front outer surface 27 of drawers, <5% of the surface area of front outer surface 27 of drawers). In this manner the front faces of drawers 22 and handles, such as handles on drawers 22, are exposed and accessible around the wire frame and through an open area 31 of the wire frame (FIGS. 5 and 6).

Figure 8:
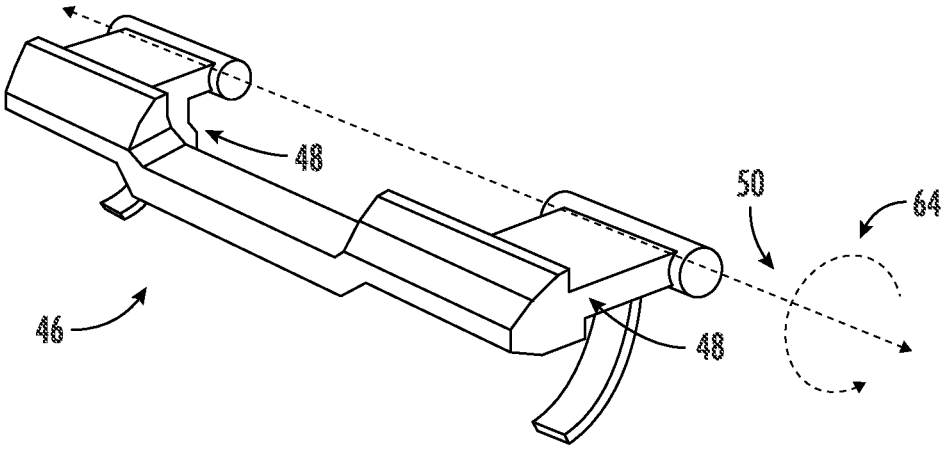
FIG. 8 is a perspective view of a portion of the tool storage device of FIG. 1, according to an exemplary embodiment.
Figure 9:
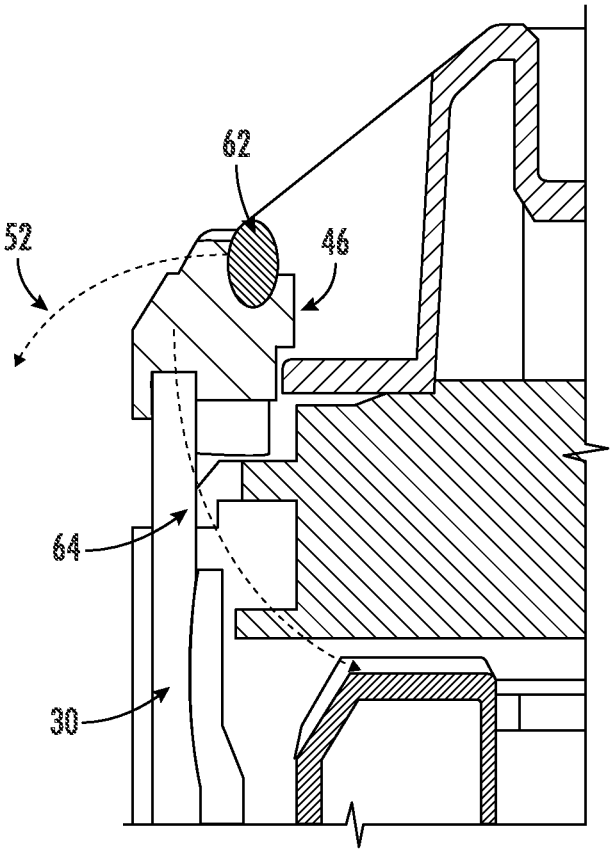
FIG. 9 is a detailed side view of the tool storage device of FIG. 3, according to an exemplary embodiment.

Turning to FIGS. 8-9, latch 46 includes recess 48 that receives door 28 when door 28 is in the locked position. To disengage latch 46 from the door 28, latch 46 is rotated with respect to housing 20 to permit door 28 to actuate from the locked position to the open position. When door 28 is in secured position, horizontal bar 62 of handle 30 interfaces with and rests within recess 48. To open door 28, latch 46 rotates in direction 64 around rotational axis 50 with respect to housing 20. After latch 46 is rotated in direction 64, door 28 is permitted to rotate in direction 52. In one embodiment latch 46 is biased opposite rotational direction 64 in the counter-clockwise direction from the perspective of FIG. 9, such as via a spring.

Figure 10:
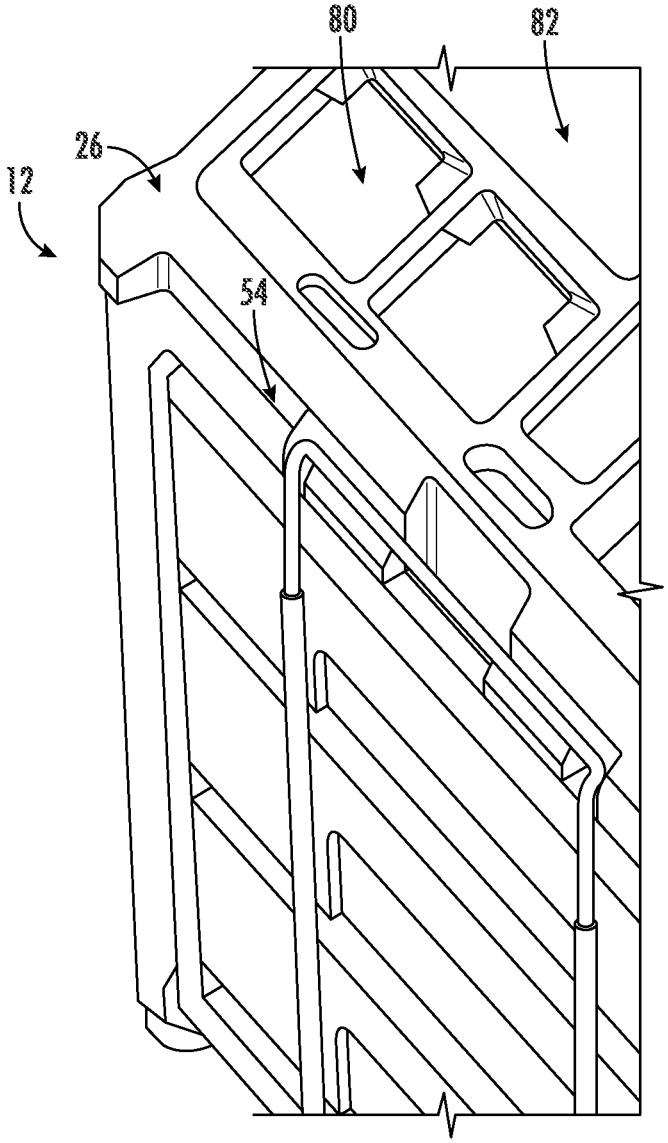
FIG. 10 is a perspective view of the tool storage device of FIG. 3, according to an exemplary embodiment.

Turning to FIG. 10, tool storage device 10 includes coupling interfaces 80 and 82 on top surface 25 of top panel 26 that permit tool storage device 10 to couple to a modular storage unit via an interface compatible with the coupling mechanism(s) described in International Patent Application No. PCT/US2018/044629. In another specific embodiment, a storage device that includes features described in this disclosure has coupling interfaces on both the top and bottom that permit the storage device to couple to a modular storage unit via an interface compatible with the coupling mechanism(s) described in International Patent Application No. PCT/US2018/044629.

Figure 11:
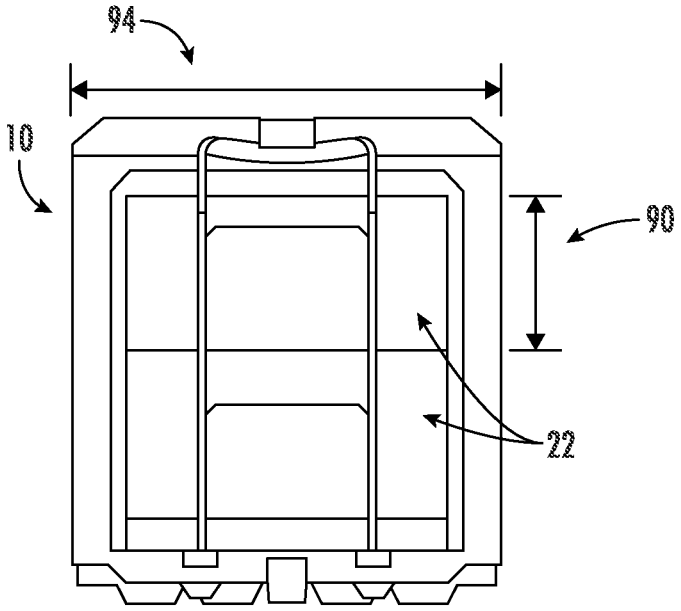
FIG. 11 is a front view of the tool storage device of FIG. 1, according to an exemplary embodiment.
Figure 12:
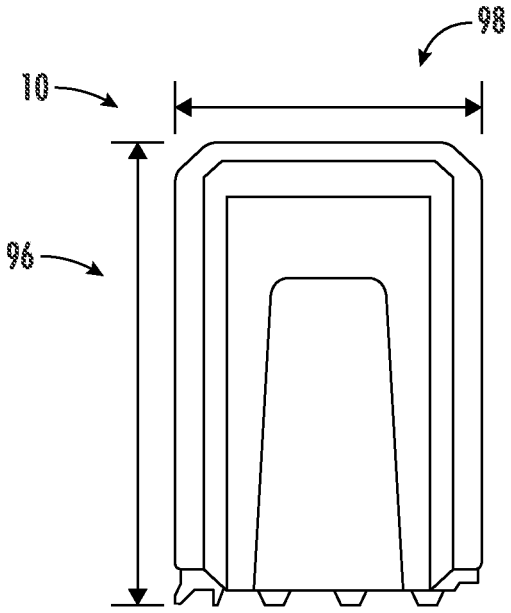
FIG. 12 is a side view of the tool storage device of FIG. 1, according to an exemplary embodiment.
Figure 13:
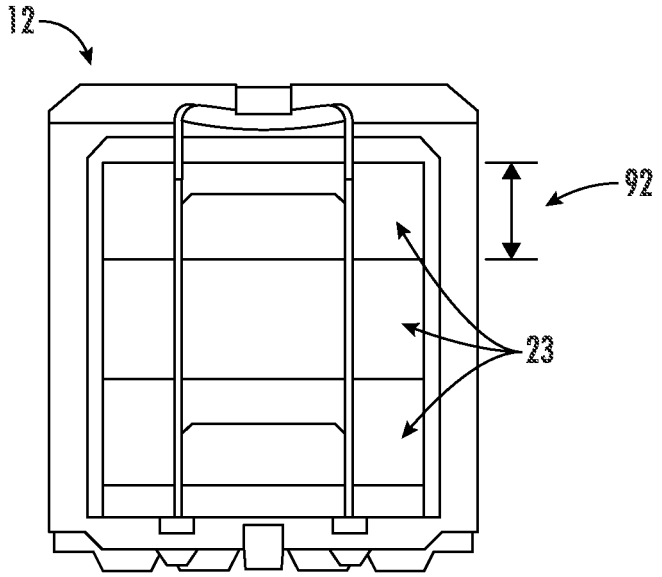
FIG. 13 is a front view of the tool storage device of FIG. 3, according to an exemplary embodiment.
Figure 14:
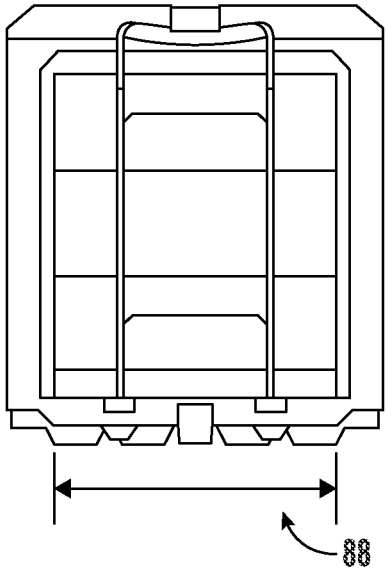
FIG. 14 is a front view of the tool storage device of FIG. 3, according to an exemplary embodiment.

Referring to FIGS. 11-12, in a specific embodiment, tool storage device 10 has a width 94 of 560 mm, a depth 98 of 416 mm, and a height 96 of 346 mm. In a specific embodiment drawers 22 have a height 90 of 124 mm. Referring to FIG. 13, in a specific embodiment, drawers 23 in tool storage device 12 have a height 92 of 81 mm. Referring to FIG. 14, in a specific embodiment drawers 23 of tool storage device 12 have a width 88 of 436 mm.

In one embodiment tool storage device 10 includes drawers 22 that slide into and out of housing 20. In another embodiment tool storage device 10 includes doors that pivotally open and define compartments 24.

Figure 15:
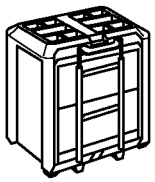
FIG. 15 shows a performance comparison of various tool storage devices, according to exemplary embodiments.
Figure 15:
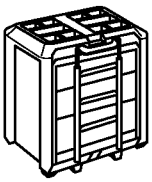

FIG. 15 shows a performance comparison of a tool storage device prepared consistent with this disclosure and a tool storage device that includes a pair of opposing doors that pivotally open to expose the drawers.

Figure 18:
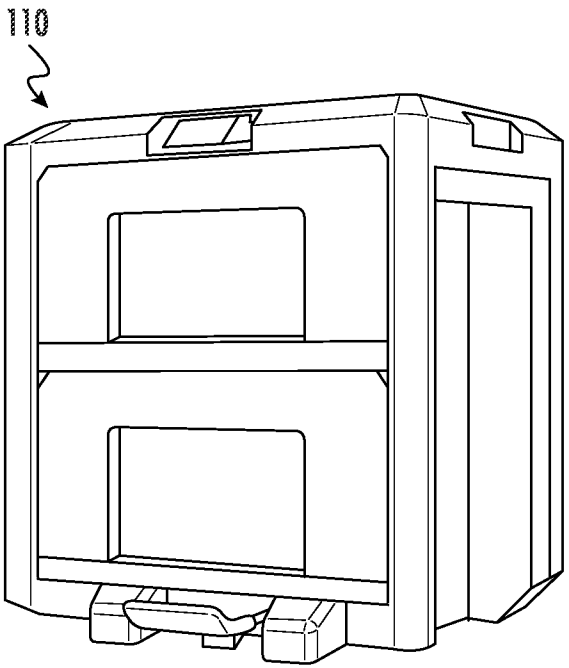
FIG. 17-18 are perspective views of the tool storage device of FIG. 16, according to an exemplary embodiment.
Figure 17:
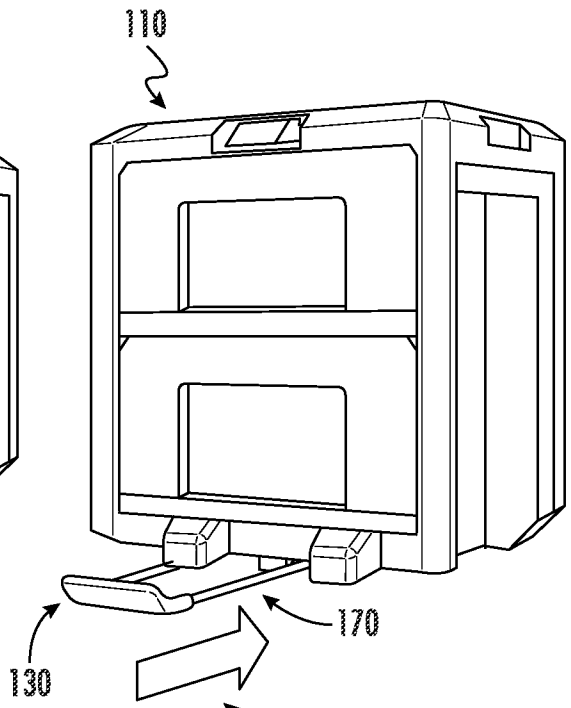
Figure 16:
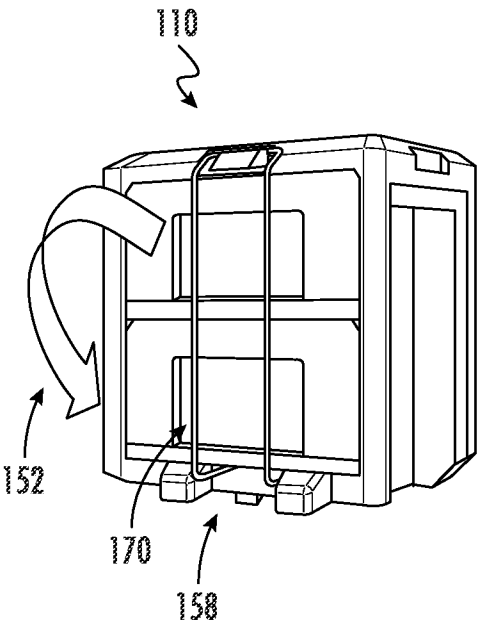
FIG. 16 is a perspective view of a tool storage device, according to an exemplary embodiment.

Referring to FIGS. 16-18, depicted is a tool storage device 110. Tool storage device 110 is substantially the same as tool storage device 10 and tool storage device 12 except for the differences discussed herein. Tool storage device 110 includes a cover, shown as wire frame 170, instead of door 28. When transitioning from the secured position to the retracted position, wire frame 170 rotates in direction 152 (FIG. 16), then slides in direction 160 into cavity 158 (FIG. 17) until handle 130 is just outside cavity 158 (FIG. 18).

Figure 19:
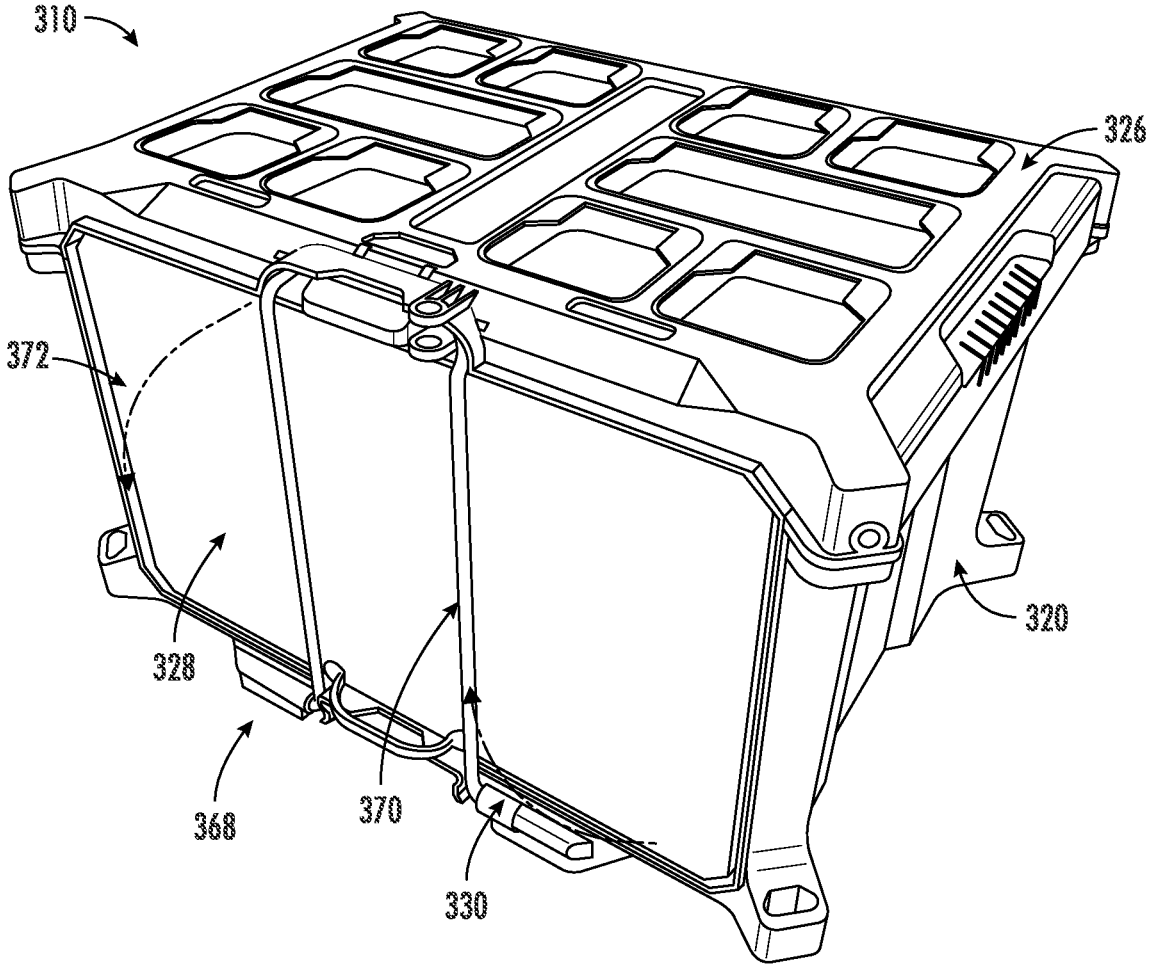
FIG. 19 is a perspective view of a tool storage device, according to an exemplary embodiment.
Figure 20:
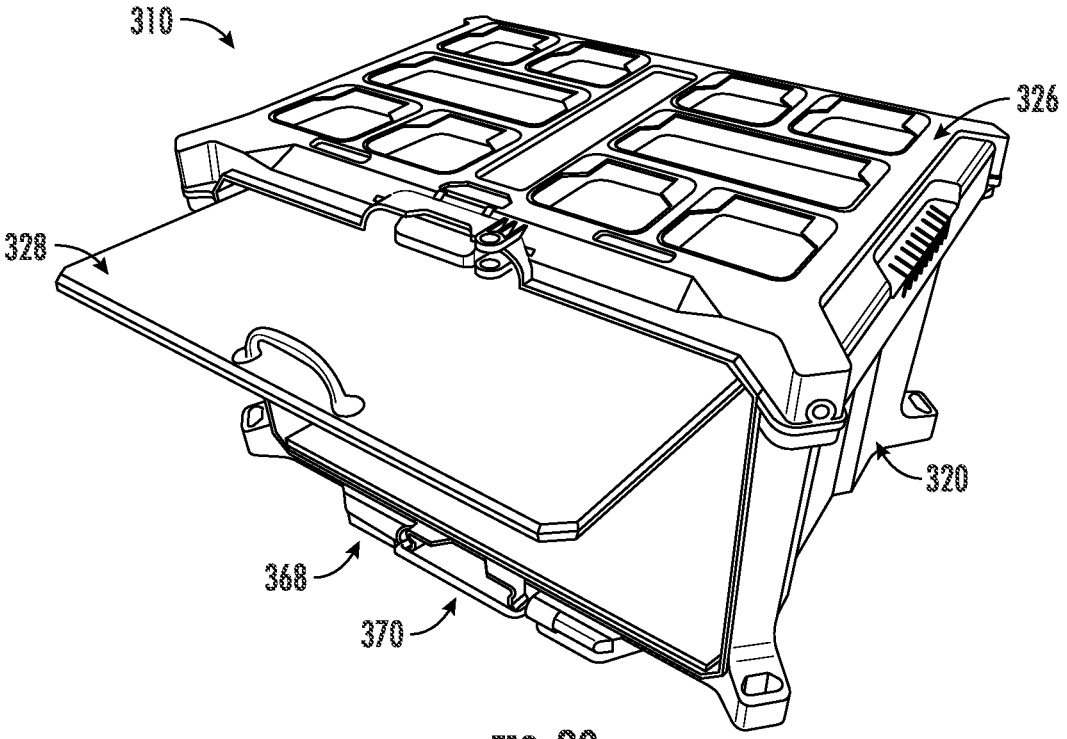
FIG. 20 is a perspective view of the tool storage device of FIG. 19, according to an exemplary embodiment.
Figure 21:
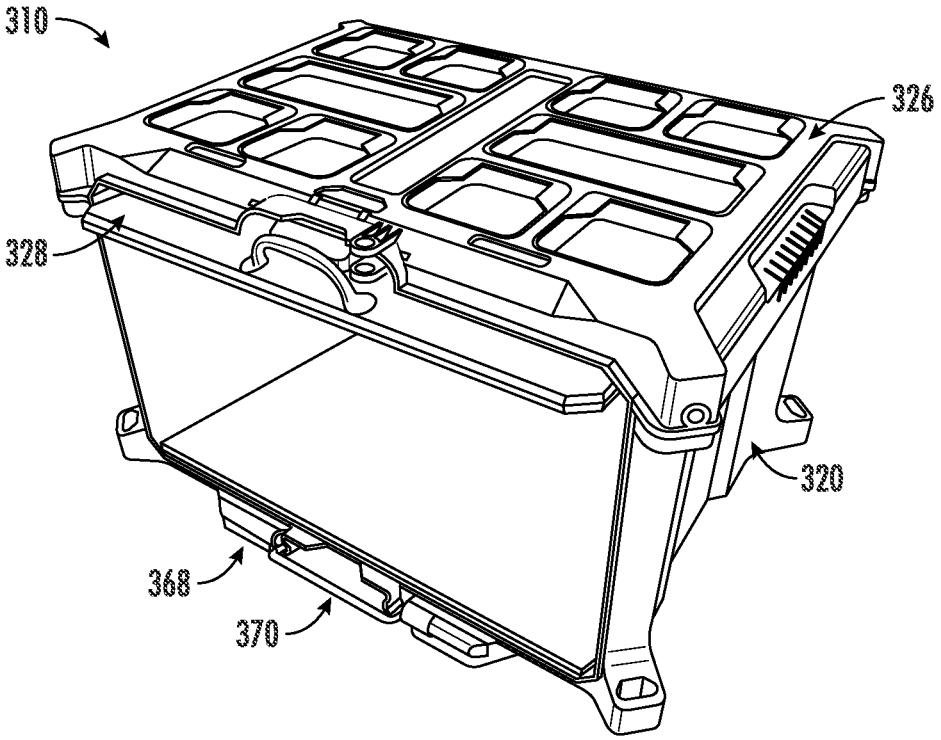
FIG. 21 is a perspective view of the tool storage device of FIG. 19, according to an exemplary embodiment.

Referring to FIGS. 19-21, depicted is a tool storage device 310. Tool storage device 310 is substantially the same as tool storage device 10 and tool storage device 12, tool storage device 110 except for the differences discussed herein. Tool storage device 310 includes a cover, shown as wire frame 370 and door 328. When transitioning from the secured position to the retracted position, wire frame 370 in direction 372 and slides into lower portion of housing 320 proximate bottom panel 368, and door 328 rotates in direction 330 and slides into upper portion of housing 320 near top panel 326. In a specific embodiment, wire frame 370 interfaces against bottom panel 368 as wire frame 370 is slid into housing 320, and door 328 interfaces against top panel 326 as door 328 is slid into housing 320.

Figure 23:
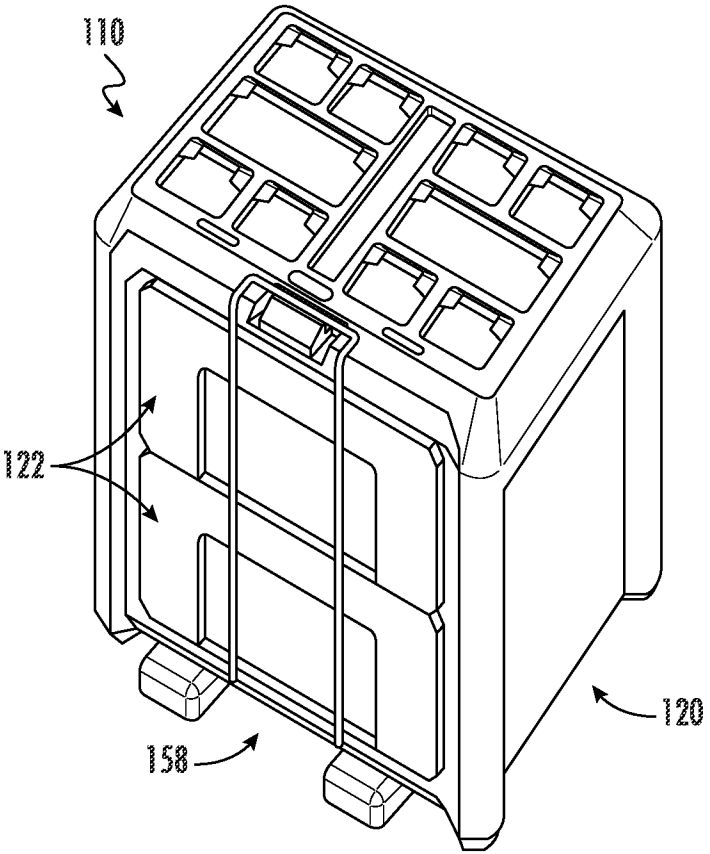
FIG. 23 is a perspective view of the tool storage device of FIG. 16, according to an exemplary embodiment.
Figure 22:
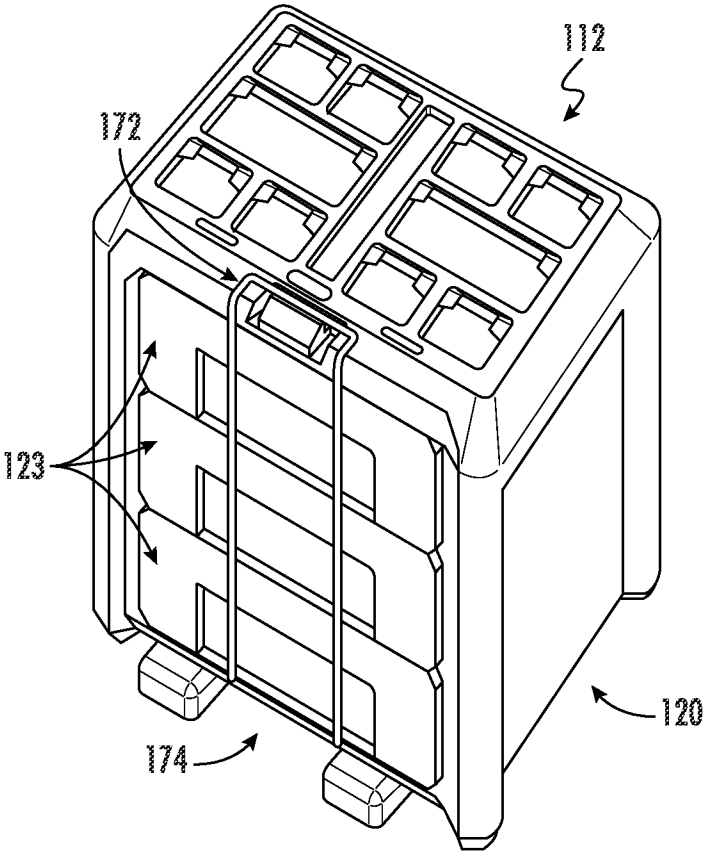
FIG. 22 is a perspective view of a tool storage device, according to an exemplary embodiment.

Turning to FIGS. 22-23, tool storage device 112 is substantially the same as tool storage device 110, tool storage device 10 and tool storage device 12 except for the differences discussed herein. Tool storage device 112 includes three drawers 123, whereas tool storage device 110 includes two drawers 122. Wire frame 170 extends from first end 172 to second end 174. Drawers 122 and 123 are retrieved from and inserted into housing 120.

Figure 24:
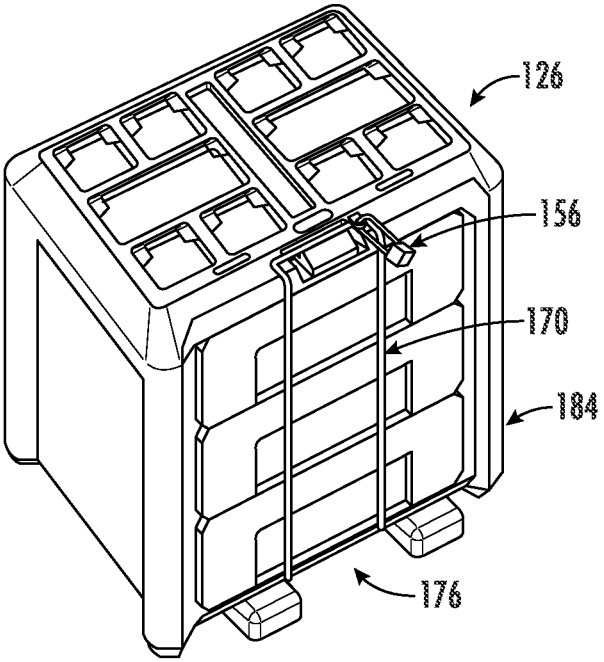
FIG. 24 is a perspective view of the tool storage device of FIG. 22, according to an exemplary embodiment.
Figure 25:
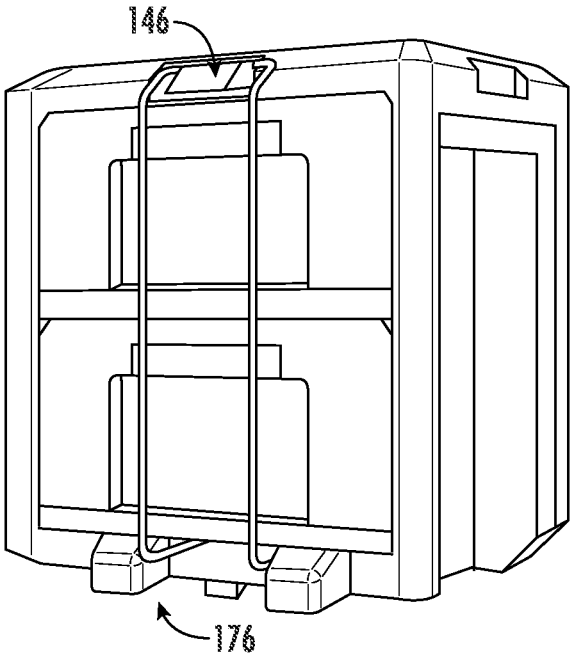
FIG. 25 is a perspective view of the tool storage device of FIG. 19, according to an exemplary embodiment.

Turning to FIGS. 24-25, a fastener, shown as pad lock 156, secures wire frame 170 to top panel 126 of the housing, which prevents wire frame 170 from being rotated in direction 152 out of the secured position. When wire frame 170 is in the secured position, wire frame 170 interfaces with latch 146. Protrusions 176 extend laterally from wire frame 170 into housing 120. When wire frame 170 transitions from the secured position to the open position, wire frame 170 rotates around protrusions 176 with respect to housing 120. Support bars, shown as aluminum front brace bars 184, are vertically positioned at each of the two front corners of housing 120.

Figure 27:
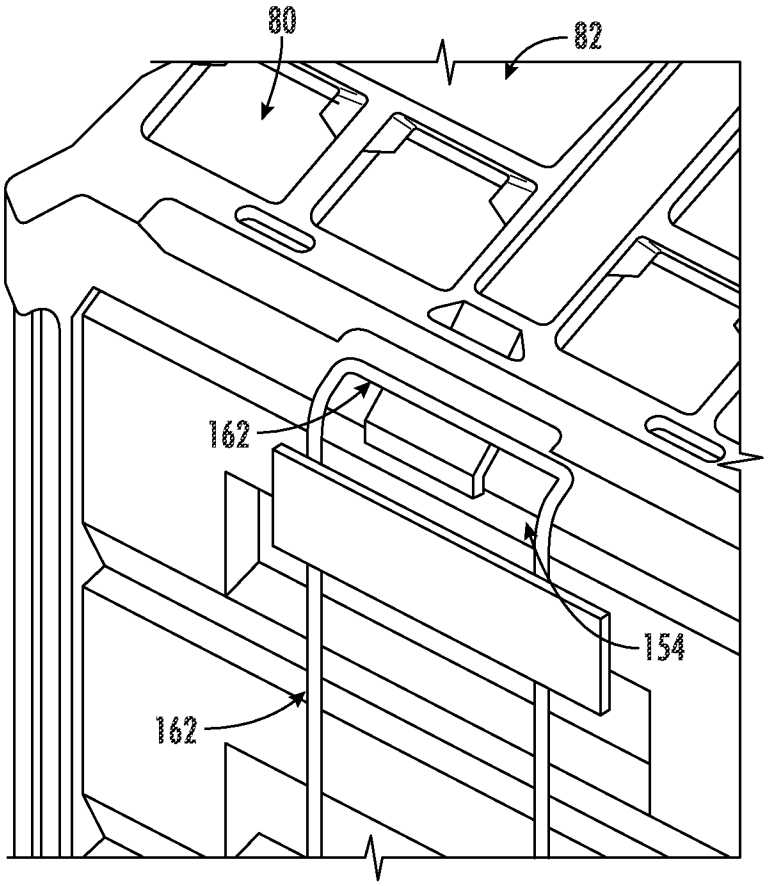
FIG. 27 is a perspective view of the tool storage device of FIG. 22, according to an exemplary embodiment.
Figure 26:
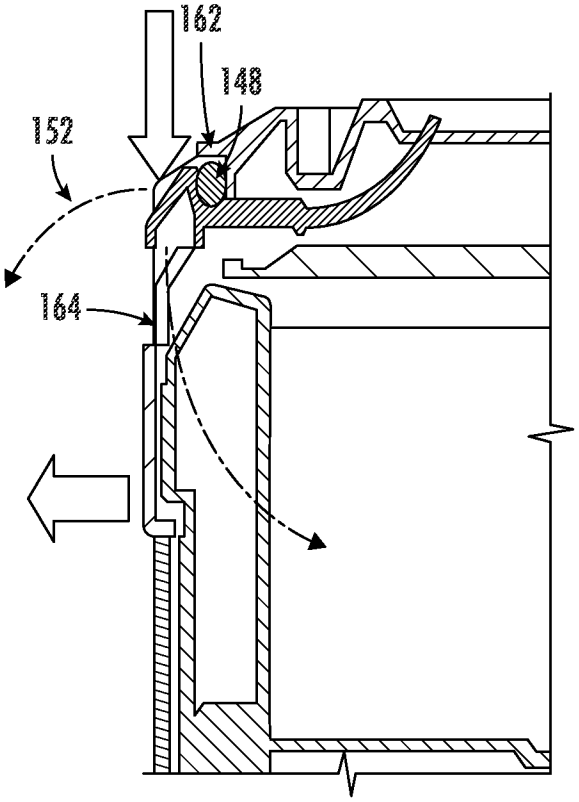
FIG. 26 is a detailed side view of the tool storage device of FIG. 22, according to an exemplary embodiment.

Turning to FIGS. 26-27, horizontal bar 162 of wire frame 170 interfaces against and within recess 148 of latch 146. To open drawers when wire frame 170 is in a secured position, latch 146 is rotated in direction 164, freeing horizontal bar 162 of wire frame 170 to rotate in direction 152. Turning to FIG. 27 in particular, lock 156 couples to apertures 154 to secure wire frame 170 in secured position. Top panel 126 includes coupling interface 80 and coupling interface 82.

Figure 29:
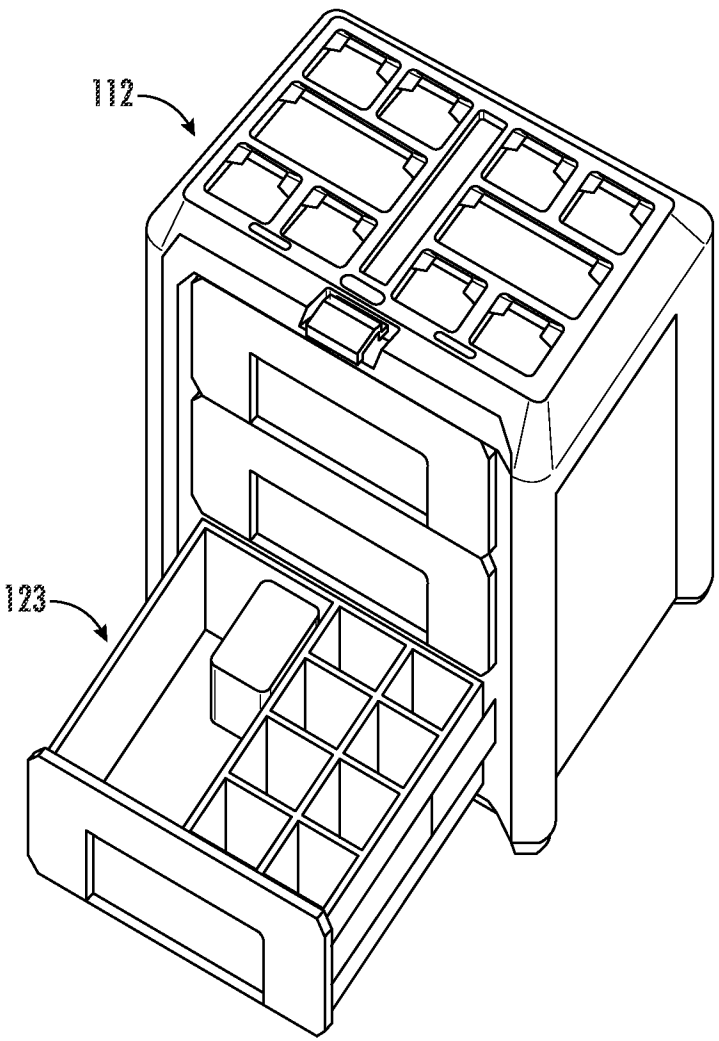
FIG. 29 is a perspective view of the tool storage device of FIG. 22, according to an exemplary embodiment.
Figure 28:
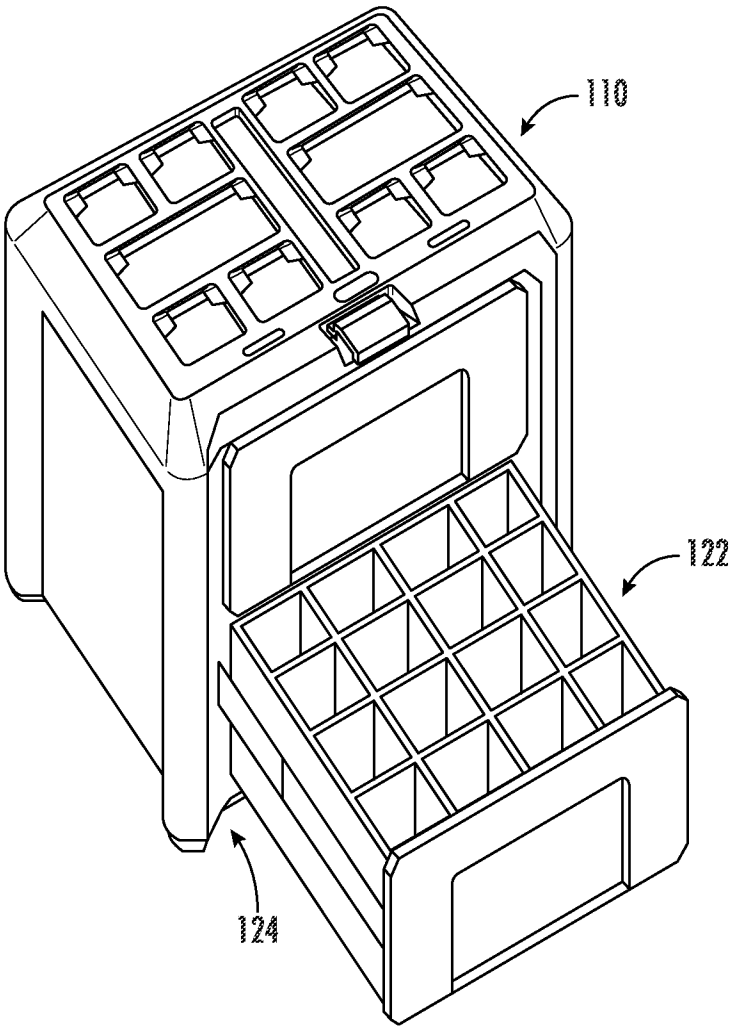
FIG. 28 is a perspective view of the tool storage device of FIG. 19, according to an exemplary embodiment.

Turning to FIGS. 28-29, tool storage device 110 and tool storage device 112 are shown with drawers 122 and 123, respectively, extending from housing 120.

Figure 30:
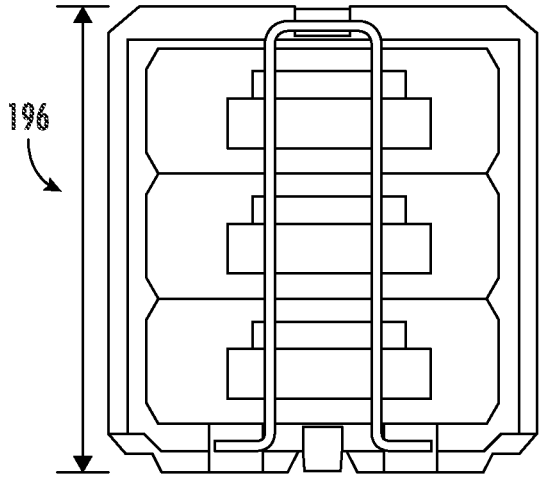
FIGS. 30-32 are plan views of the tool storage device of FIG. 22, according to an exemplary embodiment.
Figure 31:
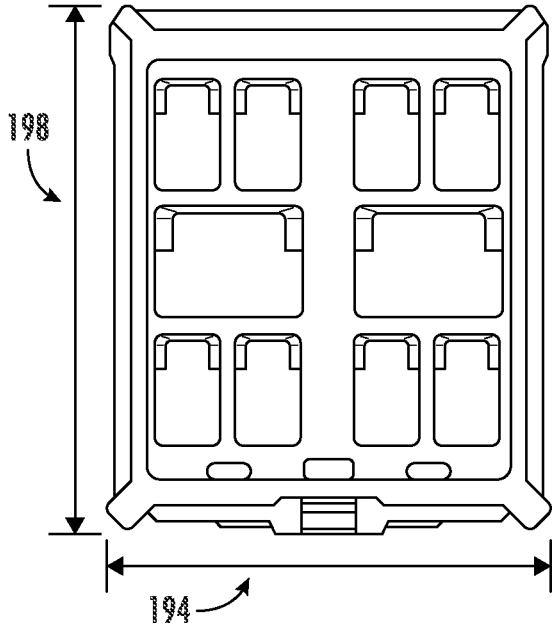
Figure 32:
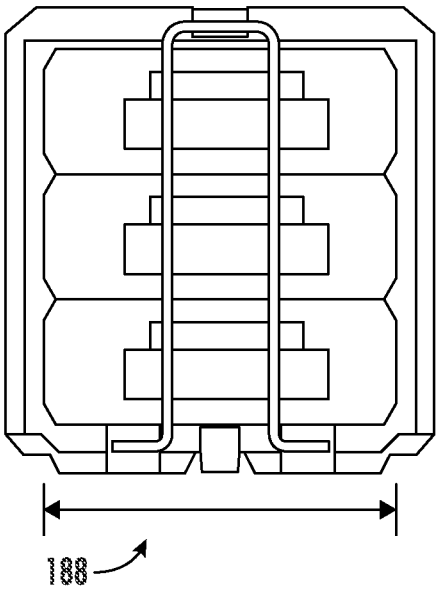

Turning to FIGS. 30-32, in a specific embodiment tool storage device 112 has a height 196 of 362 mm, a depth 198 of 410 mm, a width 194 of 560 mm, and drawers 123 have a width 188 of 458 mm.

Figure 33:
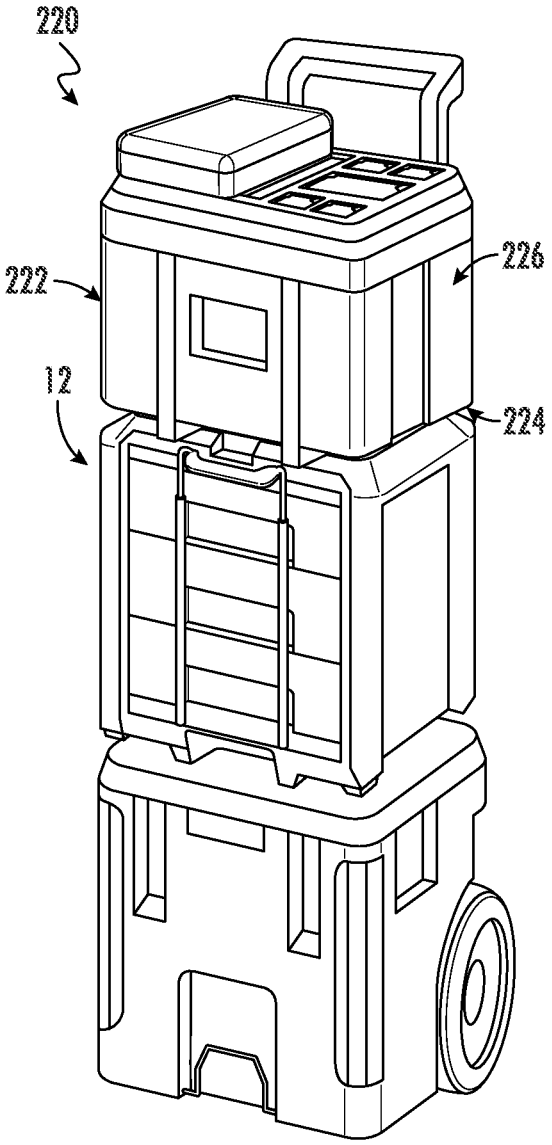
FIG. 33 is a perspective view of a modular tool storage system including the tool storage device of FIG. 3, according to an exemplary embodiment.
Figure 34:
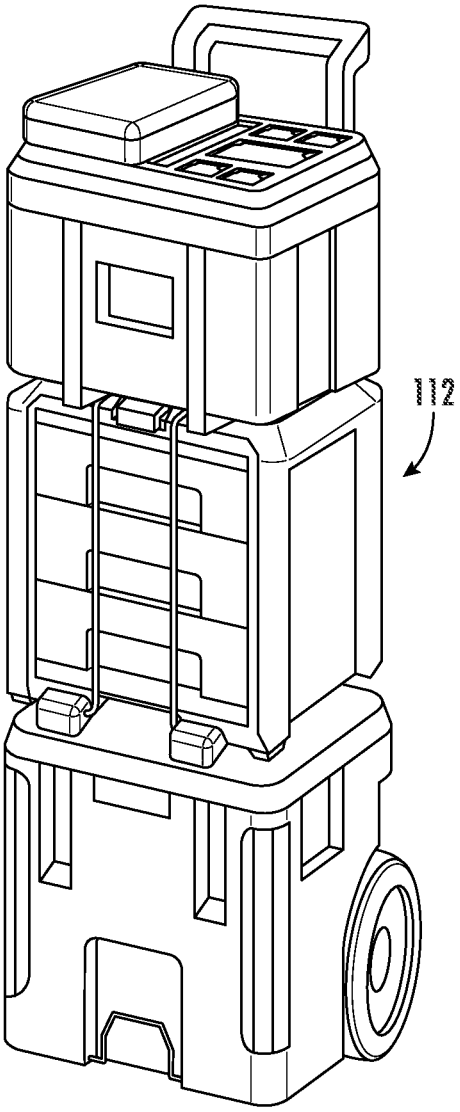
FIG. 34 is a perspective view of a modular tool storage system including the tool storage device of FIG. 22, according to an exemplary embodiment.
Figure 35:
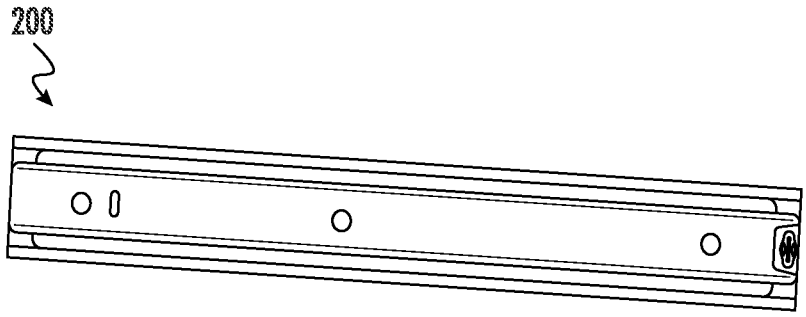
FIG. 35 is a perspective view of a component of a tool storage device, according to an exemplary embodiment.
Figure 36:
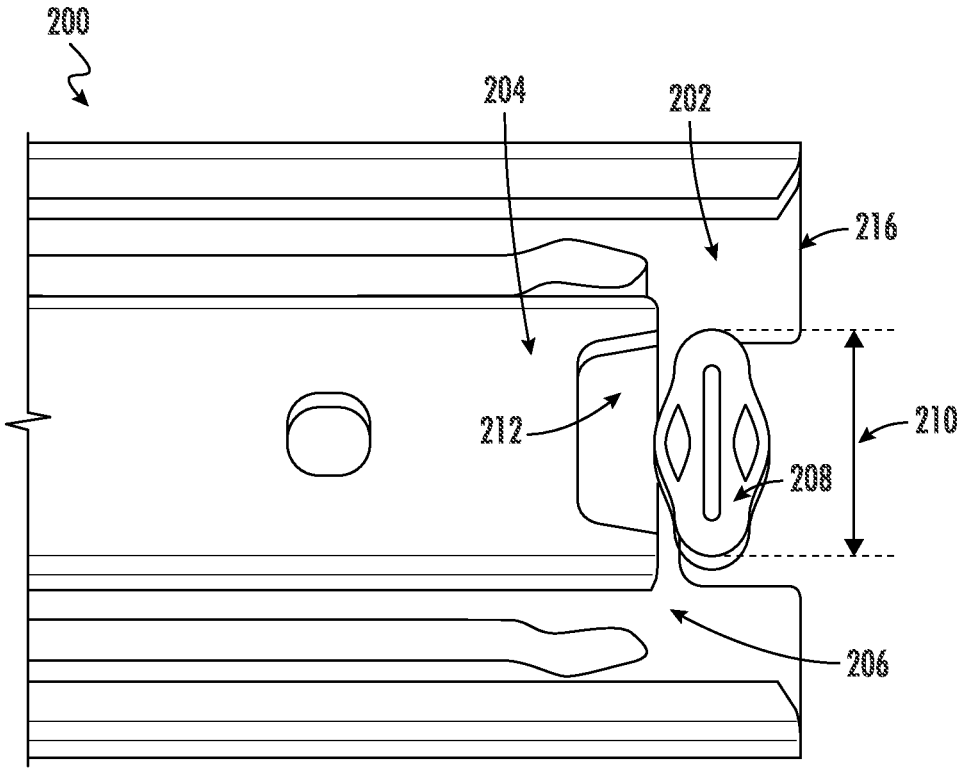
FIGS. 36-40 are perspective views of a component of FIG. 35, according to an exemplary embodiment.
Figure 37:
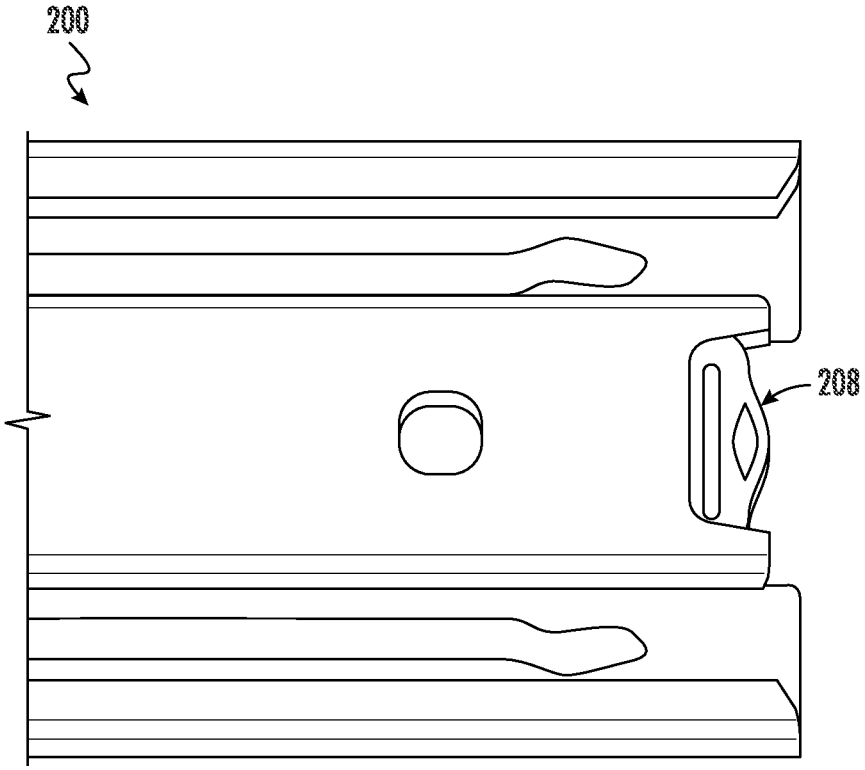
Figure 38:
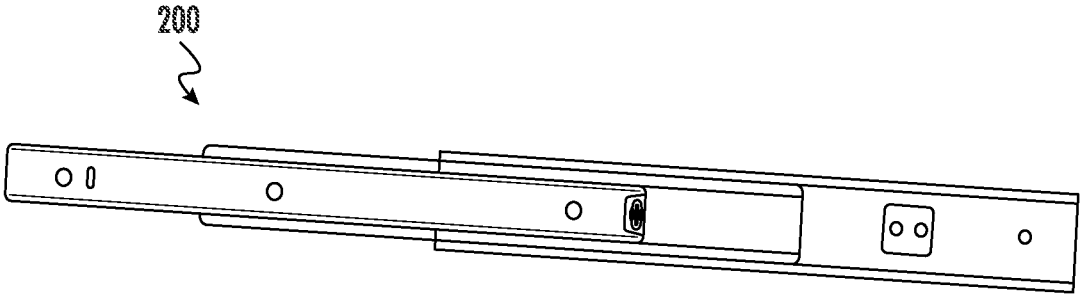
Figure 39:
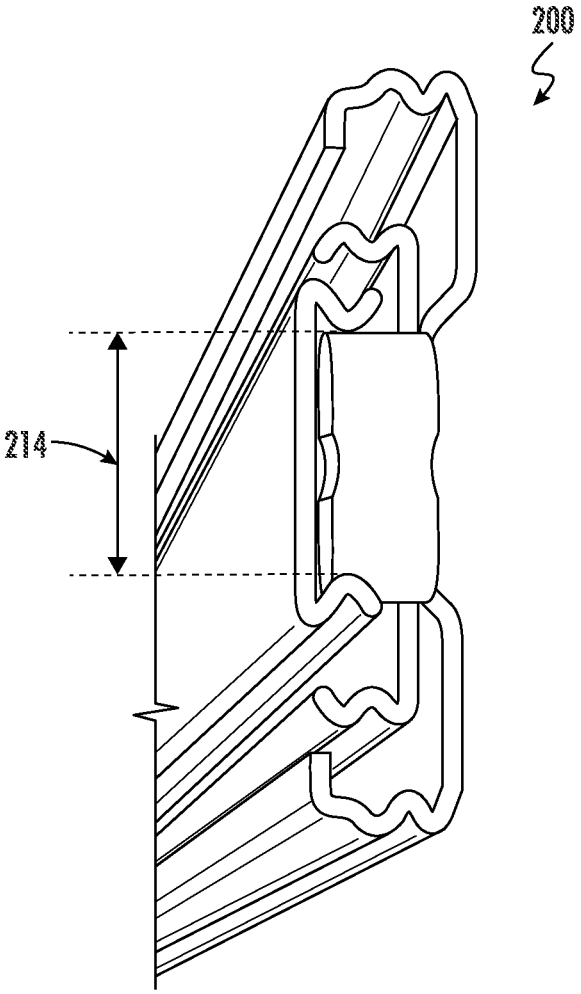
Figure 40:
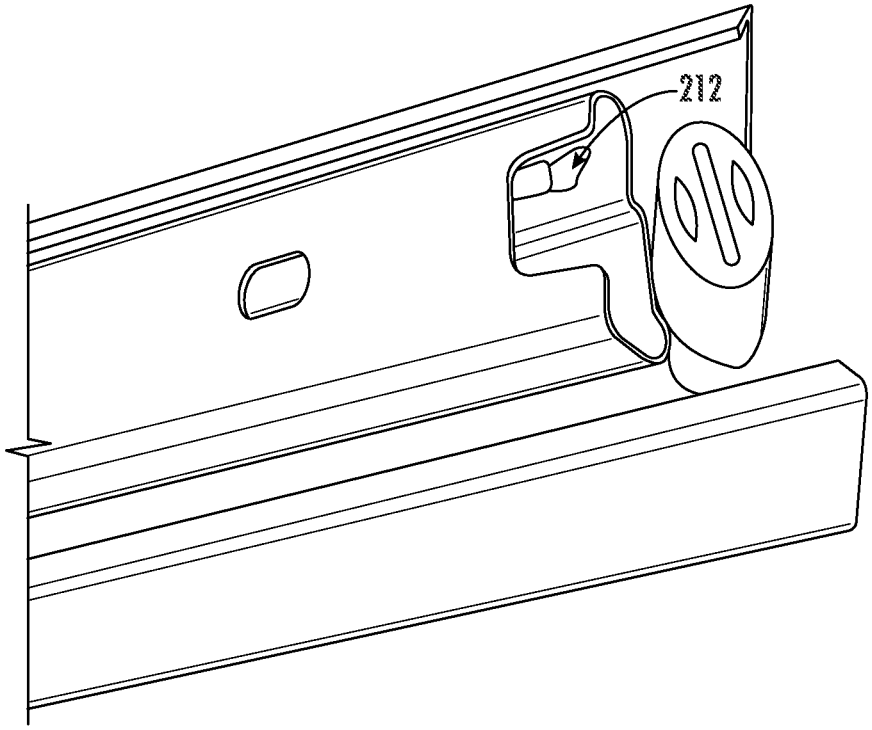

Turning to FIGS. 33 and 34, depicted are modular tool storage system 220 that incorporates tool storage device 12 and tool storage device 112. In a specific configuration, modular tool storage system 220 includes tool storage device 12 and storage unit 222. Storage unit 222 is similar to tool storage device 10 and tool storage device 12 except for the differences described herein. Storage unit 222 includes a lower surface 224, a second interface located along the upper surface, the second interface configured to detachably engage with the first interface of tool storage device 12, and a housing 226 defining a storage compartment.

Turning to FIGS. 35-40, depicted is rail 200 according to an exemplary embodiment. Various embodiments of tool storage devices 10, 12, 110 and 112 include one or more rails 200. Rail 200 is coupled to housing 20, 120 and drawer 22, 23, 122, 123 to permit drawer 22, 23, 122, 123 to slide into and out of housing 20, 120.

Fixed portion 202 is coupled to housing 20, 120 and slidable portion 204 is coupled to drawer 22, 23, 122, 123. Slidable portion 204 slidably coupled to fixed portion so that slidable portion 204 slides along the longitudinal axis of fixed portion 202. As a result, rail 200 defines a variety of lengths depending on the relative orientation of slidable portion 204 and fixed portion 202.

A securing component, shown as stop 208, permits drawer 22, 23, 122, 123 to be secure within housing 20, 120. As internal end 206 of slidable portion 204 slides towards internal end 216 of fixed portion 202, protrusions 212, shown as barbs, interface against stop 208. The friction between protrusions 212 and stop 208 increase the amount of force necessary to slide slidable portion 204. As a result, when rail 200 is positioned at its shortest length (e.g., when internal end 216 is nearest internal end 206), extra force is required to unseat protrusion 212 and move protrusion 212 past stop 208 as compared to when protrusions 212 and stop 208 are not interfacing.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

I claim:

1. A container comprising:

a housing;

a connection recess located along an upper surface of the housing, the connection recess configured to couple the housing to a modular tool storage device, the connection recess comprising a recessed surface and two wings extending over the recessed surface;

a drawer slidably coupled to the housing, the drawer actuating between an open position and a closed position, the drawer enclosing a compartment; and a retainer pivotally coupled to the housing, wherein the retainer comprises an elongate, continuous metal frame surrounding a central open area, wherein the retainer actuates between at least two positions:

a locked position, in which the drawer is restricted from being moved from the closed position to the open position; and a stowed position, in which the retainer is retracted within the housing and the drawer can be moved from the closed position to the open position.

2. The container of claim 1, the retainer comprises protrusions that extend laterally away from each other and which pivotally couple the retainer to the housing.

3. The container of claim 1, comprising a fastener that secures the retainer to the housing.

4. The container of claim 1, the two wings extending from one end of the connection recess above and offset from the recessed surface of the connection recess.

5. The container of claim 4, wherein the two wings extend along opposing sides of the connection recess.

6. The container of claim 1, comprising a plurality of connection recesses including the connection recess, the plurality of connection recesses comprising a front row of at least two connection recesses aligned with each other in a direction parallel to a front face of the housing and a rear row of at least two connection recesses aligned with each other in the direction parallel to the front face of the housing, wherein each of the plurality of connection recesses comprises a recessed surface and two wings extending over the recessed surface, the two wings extending on opposing sides of the connection recess from one end of the connection recess.

7. A modular storage system comprising:

a container comprising:

a housing comprising a top panel, a bottom panel, and a sidewall extending between the top panel and the bottom panel, and an interior space defined by the top panel, the bottom panel and the sidewall;

a connection recess located along an upper surface of the housing, the connection recess configured to couple the housing to a modular tool storage device, the connection recess comprising a recessed surface and two wings extending over the recessed surface;

a drawer slidably coupled to the housing, the drawing extending and retracting through the sidewall from the interior space, the drawer enclosing a compartment, the drawer actuating between an open position and a closed position; and a retainer pivotally coupled to the housing, wherein the retainer comprises an elongate, continuous metal frame surrounding a central open area, wherein the retainer actuates between at least two positions:

a locked position, in which the drawer is restricted from being moved from the closed position to the open position; and a stowed position, in which the retainer is retracted within the housing and the drawer can be moved from the closed position to the open position; and a storage unit comprising a lower surface, a first interface located along the upper surface, the first interface configured to detachably engage with the connection recess of the container, and a second housing defining a storage compartment.

8. The modular storage system of claim 7, wherein the sidewall is a front of the housing.

* * * * *